US005316403A

United States Patent [19]

Mansour

[11] Patent Number: 5,316,403

[45] Date of Patent: May 31, 1994

[54] APPARATUS FOR APPLYING A FILM OF LIQUID

[76] Inventor: Amin F. Mansour, P.O. Box 645, Snellville, Ga. 30278

[21] Appl. No.: 991,207

[22] Filed: Dec. 15, 1992

[51] Int. Cl.[5] ..... B43M 11/06

[52] U.S. Cl. ..... 401/207; 401/202; 401/23; 401/25; 401/261

[58] Field of Search ..... 401/205-207, 401/196, 261, 276, 186, 263, 266, 25, 23, 232, 242, 198, 199

[56] References Cited

U.S. PATENT DOCUMENTS

| | | | |
|---|---|---|---|
| D. 250,537 | 12/1978 | Stephens | D19/2 |
| 1,099,262 | 6/1914 | Martin et al. | 401/276 |
| 1,179,080 | 4/1916 | Davis | 401/205 |
| 1,910,669 | 5/1933 | Biederman | 401/263 |
| 2,308,215 | 1/1943 | Stern | 401/207 |
| 2,315,996 | 4/1943 | Workman | 401/186 |
| 2,565,104 | 8/1951 | Trill | 401/206 |
| 2,687,543 | 8/1954 | Mendelevitch | 401/207 |
| 2,924,837 | 2/1960 | Lehre | 15/136 |
| 3,195,544 | 7/1965 | Politzer | 401/198 X |
| 3,266,079 | 8/1966 | Schwartzman | 401/206 X |
| 4,384,589 | 5/1983 | Morris | 401/199 |
| 4,771,727 | 9/1988 | White et al. | 118/258 |
| 5,073,227 | 12/1991 | Rehberg | 156/441.5 |
| 5,074,455 | 12/1991 | Peana et al. | 401/198 X |

*Primary Examiner*—Danton D. DeMille
*Attorney, Agent, or Firm*—Kennedy & Kennedy

[57] ABSTRACT

A moistener having a porous applicator tip attached to an upper end of a container holding liquid with an opening in the surface of the applicator tip communicating with a tube to allow the replacement of the loss of volume equivalent of air in the container during use of the apparatus to apply a film of water to a surface.

4 Claims, 1 Drawing Sheet

APPARATUS FOR APPLYING A FILM OF LIQUID

TECHNICAL FIELD

The present invention relates to apparatus for applying a film of liquid to a surface. More particularly, the present invention relates to an apparatus for applying liquid to a surface by gravity flow from a container.

BACKGROUND OF THE INVENTION

Devices that apply a film of liquid to a surface have been known before. Typically, such devices are used for applying the film of liquid or moisture to a gummed flap of an envelope for sealing the same. For example, U.S. Pat. No. 5,073,227 issued to Rehberg describes a moistening device for the application of a liquid film to a gummed surfaces of an envelope flap. The moistening device includes a reservoir for holding water. A sponge sits on a support within the reservoir. A brush holder is supported above the reservoir and holds a brush and an absorptive strip that extends over the length of the brush. The absorptive strip has an angled end which is disposed in the liquid. The brush accordingly is sandwiched between the absorptive strip and the sponge so as to be continuously supplied with liquid. The bristles of the brush take up liquid from the sponge and the strip. The brush transfers the water to a gummed flap that is moved in contact with the brush. A porous material, such as felt, fleece or foam material with large pores, is used as the material for the sponge and the absorptive strip.

U.S. Pat. No. 4,771,727 issued to White et al describes a liquid dispensing applicator for moistening glue on stamps, envelopes and the like. A liquid holding tank with an open top rotatably supports a roller. The roller extends slightly above the open top of the tank. The liquid in the tank is picked up on the roller by rotation. The liquid transfers to a gummed surface by passing the envelope, the stamp, or the like in contact with the rotating roller.

The devices discussed above are particularly suited for use in postage metering devices and the like. Hand held containers having a porous tip also are known for applying a film of liquid to surfaces. For example, U.S. Pat. No. 2,924,837 issued to Lehre describes a moistener having a reservoir with a liquid dispensing tip for applying a film of moisture to a gummed lap of an envelope. The porous tip is a foamy sponge secured to a chamber at an upper end of the reservoir. During use of the apparatus, the reservoir container is squeezed to fill the chamber behind the foam with liquid. The sponge then communicates the liquid from the chamber to the surface in contact with the foamy sponge. While this device accomplishes the goal of applying a liquid film to a surface, it has drawbacks which limit its utility. The squeezing and pumping action may provide a very irregular pattern of liquid flow to reach the tip of the foam sponge. It is difficult to achieve a smooth and even flow of moisture through the sponge tip. Occasionally a large amount of liquid may be released through the sponge tip by a forceful squeeze of the container. This release may damage the surface to which the moisture is being applied. In addition, the useful life of the foam sponge is relatively short.

Other devices, such as markers, also provide a film of liquid to a surface. These devices typically have a solid body container with a fibrous wick that communicates the liquid from a reservoir to the dispensing tip. These devices however are not refillable and are therefore not reusable and economical. Further, the quantity of useable fluidal material contained within such devices is much less. The volume accepted by the wick reduces the available volume for the fluidal material as compared with a same size container without a wick.

Accordingly, there is a need in the art for a rigid body moistener that does not require a wick for applying a film of liquid to a surface.

SUMMARY OF THE PRESENT INVENTION

The present invention meets the need in the art by providing a gravity flow moistener for applying a film of liquid to a surface. Generally described, the present invention provides a rigid body container for holding a quantity of a liquid, a porous applicator attached at one end of the container, and a tube that communicates air from an opening in the applicator tip to the interior of the container.

More particularly described, the present invention provides a rigid container for holding a supply of a liquid. The container has a necked opening at a first end. An applicator tip is received in the end for communicating liquid from the container to the surface in contact with the tip. The applicator tip comprises a blade at a first end and a handle at a second end for being received in a coupler that connects to the neck end of the container. A tube extends from the applicator tip into the container. The tube communicates with an opening in the surface of the applicator tip. Air passes through the opening and the tube into the container to replace the liquid dispensed from the container.

Accordingly, it is the object of the present invention to provide a moistener which applies a thin film of liquid to a surface.

It is another object of the present invention to provide a moistener using gravity flow to communicate a liquid from a reservoir to an applicator tip.

It is another object of the present invention to provide a moistener having an applicator tip with a durable life time.

Still other objects, features and advantages of the present invention will become apparent upon a reading of the following detailed description in conjunction with the drawings and the appended claims.

DETAILED DESCRIPTION

Figure 1:
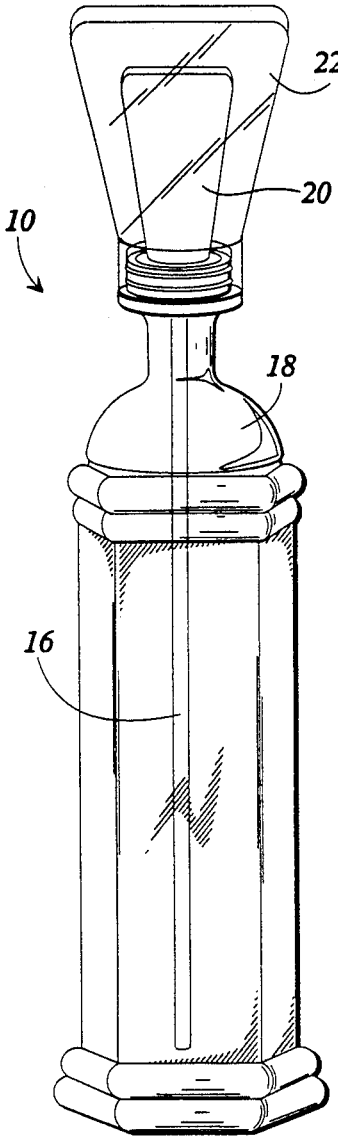
FIG. 1 is a side view of a moistener constructed according to the present invention.
Figure 2:
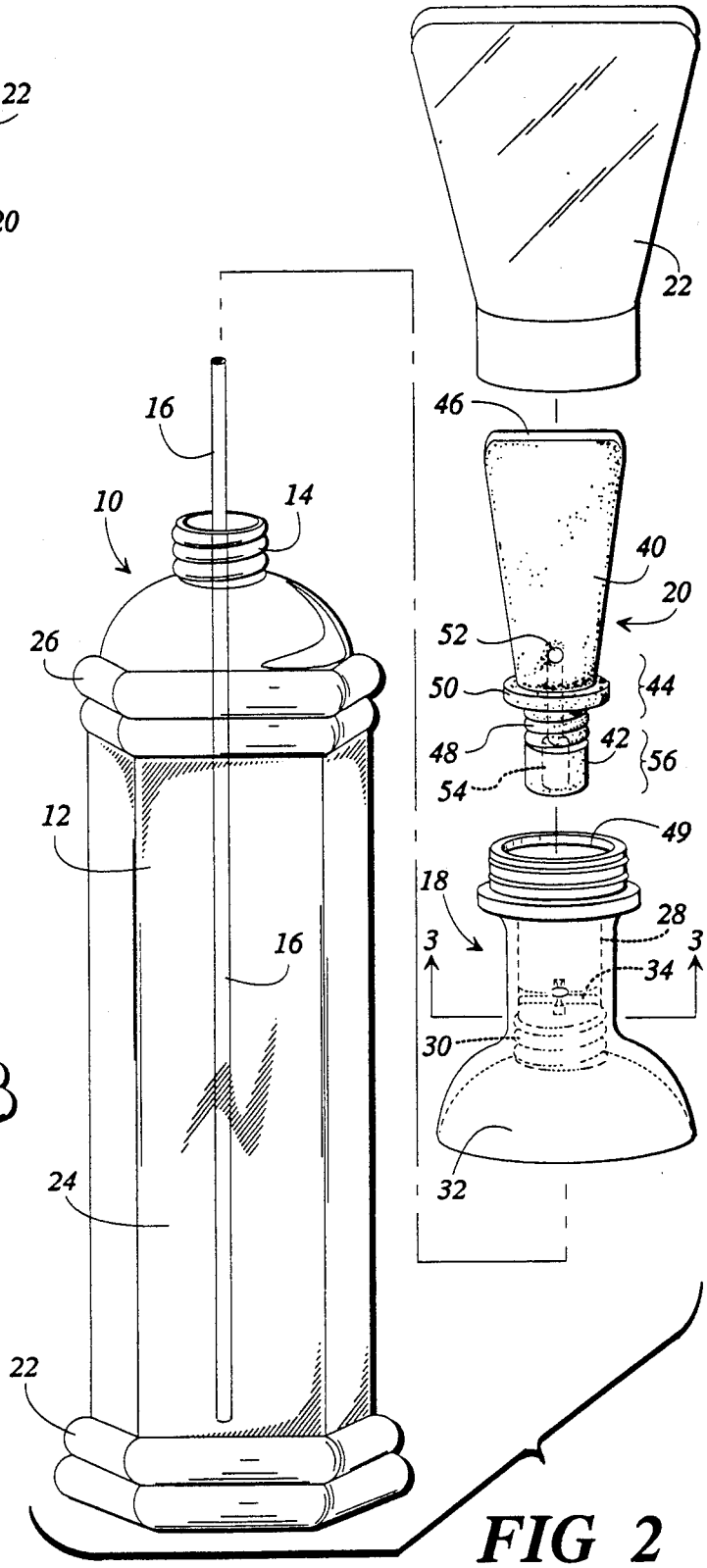
FIG. 2 is an exploded side view showing the parts of the moistener illustrated in FIG. 1 in more detail.

Referring now in more detail to the drawings, in which like numerals indicate like parts throughout the several views, FIGS. 1 and 2 show a side view of a moistener 10 constructed in accordance with the present invention. FIG. 2 shows an exploded view for more detail. The moistener 10 comprises a container 12 having a necked opening 14 at a first end. A tube 16 passes through the opening 14 into the container 12, for a purpose discussed below. The upper end of the container 12 receives a coupler 18 which holds an applicator tip 20 for communicating liquid from the container 12 to a surface in contact with the applicator tip. A cap 22 is received over the applicator 20 by the coupler 18 for enclosing the applicator tip 20 when the moistener 10 is not in use.

The container 12 in the illustrated embodiment defines an elongate cavity for receiving a supply of liquid. The container 12 has a base 22 allowing the container to be conveniently stored in an upright position. The container is made of a rigid material to resist squeezing, so that liquid in the container is not forced therefrom under pressure into and out of the applicator tip 20. The container 12 is preferably translucent or transparent, to facilitate monitoring the volume of liquid in the container. The illustrated embodiment has six sides 24 with an upper crowning 26 near the opening 14. The opening 14 in the illustrated embodiment is a threaded neck extending upwardly from the container 12.

Figure 3:
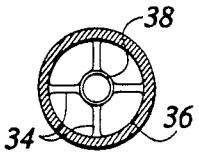
FIG. 3 is a cross-sectional view taken along line 3-3 of FIG. 2, illustrating an annular ring to support a tube that communicates between the container and the atmosphere.

The coupler 18 has a bore 28 which is threaded at a first end 30 for matingly engaging the threaded neck of the opening 14. The coupler 18 has a lower portion 32 which is configured to the shape of the upper end of the container 12 to facilitate joining the coupler 18 to the container 12. The bore 28 in a preferred embodiment includes four arms 34 extending radially from an inner wall 36 of the bore 28. As best illustrated in FIG. 3, the arms 34 connect to an annular ring 38 concentrically disposed on the longitudinal axis of the bore 28. The tube 16 passes through the annular ring 38 to maintain the tube in a central position with respect to the container 12, as discussed below. The arms 34 and the annular ring 38 preferably have a thickness of between about 1 to 2 millimeters. The inner diameter of the annular ring 38 preferably is slightly greater than the outer diameter of the tube 16 to grippingly hold the tube therein.

The applicator tip 20 comprises a blade 40 at a first end and a handle 42 at the second end. The blade 40 in the illustrated embodiment has the shape of an inverse triangle, tapering outwardly from a mid-portion 44 of the applicator tip 20 to the tip 46 of the blade 40. In a preferred embodiment, the blade 40 has a thickness of 5 millimeters with the tip 46 of the blade 40 approximately 15 millimeters wide. The tip 46 preferably is flat cut and rounded at the upper ends thereof to taper with the sides to the mid-portion 44.

The handle 42 is configured for being received by the bore 28 of the coupler 18. In the illustrated embodiment, the handle 42 is cylindrical. In a preferred embodiment, the handle has a 5 millimeter diameter and a length of approximately 20 millimeters. In the illustrated embodiment, a portion 48 of the handle 42 is threaded for screwing into the upper end of the bore 28. The upper end of the bore 28 grippingly receives the handle 42 which is twistingly inserted in the bore. The upper end of the bore 28 may be threaded or not for securing the applicator tip 20 therein. The mid-portion of the applicator tip defines a disc 50 for seating in a groove 49 in the upper end of the bore 28. The disk 50 extends outwardly of the applicator tip 20 and wedges into the groove 49 to further couple the applicator tip 20 in the top 18. In an alternate embodiment, the disc 50 in cross-sectional view has the shape of a cone. The cone lodges in the mouth of the bore 28 by screwing the handle 42 of this embodiment into the upper portion of the coupler 18.

The applicator tip 20 also includes an opening 52 which communicates with a capillary bore 54 along the longitudinal axis of the applicator tip 20. In a preferred embodiment of the present invention, the bore 54 has an inner diameter of between about 1 to 2 millimeters. A lower portion 56 of the bore 54 is enlarged for grippingly receiving the upper end of the tube 16. The opening 52 and the tube 16 received in the bore 54 cooperate to allow the return of air therethrough from the atmosphere to the container 12. The return of the air replaces the vacuum and adjusts the pressure of the container during operation of applying a film of liquid to a surface with the moistener 10. As discussed above, the tube 16 passes through the annular ring 38 int he top 18. The ring 38 keeps the tube 16 near the longitudinal axis of the container 12.

The cap 22 encloses the applicator tip 20 when the moistener 10 is not in use. The cap 22 attaches to an upper end of the coupler 18. This attachment may be accomplished preferably by a snap fit or by threaded connectors on the lower base of the cap 22 an the upper end of the coupler 18.

The moistener of the present invention 10 is operated by removing the coupler 18 from the container 12. The tube 16 is thereby withdrawn from the container 12, as it is grippedly engaged in the bore 54 of the applicator tip 20. The container 12 is then filled with a liquid, such as water for moistening gummed flaps of envelopes. The coupler 18 is then threadedly engaged to the neck opening 14 to couple the applicator tip 20 to the container 12.

To use the moistener 10, the cap 22 is disengaged from the coupler 18. The container 12 is inverted and the applicator tip 20 is brought into contact with a surface to receive a film of the liquid. For example, the moistener 10 may be sued to apply water to the gummed flap of an envelope. The tip 46 of the blade 40 is brought into contact with the surface. The moistener 10 is then moved relative to the surface to draw the blade 40 across the surface. It si preferred that the movement be from left to right, for a right-handed user, so as to view the application of liquid and avoid disturbing the wetted surface. The direction of movement for a left-handed user preferably is right to left. The liquid in the container 12 is communicated from the container through the coupler 18 and the applicator tip 20 onto the surface, leaving a uniform film of liquid thereon.

The gravity flow of the liquid from the reservoir container through the applicator tip provides a device for dispensing water, alcohol, ink, and color as an application of uniform film onto a surface. The moistener of the present invention is particularly useful in moistening gummed surfaces, and also is useful in coloring, highlighting, and other office and industrial use and art craft. The viscosity of the liquid preferably ranges from low (such as for water) to about 500 centipoise and possibly higher for effective flow through the applicator tip 20. The applicator tip 20 in a preferred embodiment is made of felt or a porous plastic having a pore size of between about 20 to about 500 microns. The felt preferably is of a polyester or wool material. The applicator tip 20 in a preferred embodiment is made of a high density polyethylene plastic.

The rate of flow can be adjusted by modification or selection of the felt density or pore size of the porous plastic, by the viscosity of the material to be used, and by the hydrophilic or hydrophobic nature of the material comprising the applicator tip. A lower density felt or larger pore size permits more of a given liquid to flow through the applicator tip. Similarly, a liquid having a low viscosity will flow more quickly through a given applicator tip than a liquid with a higher viscosity. Hydrophilic materials are used with water based liquids; hydrophobic materials are used for oil based liquids.

A preferred embodiment of the illustrated moistener 10 provides a solid body container 12 having a capacity of about 35–55 milliliters of water for uniform and even application of a film of water to a gummed surface. The container 12 is made of a rigid plastic so that during use of the moistener 10, an inadvertent squeeze does not result in an excessive amount of water being forced from the application tip. The opening 52 in the applicator tip 20, the bore 28, and the tube 16 preferably have a common inner diameter of between about 1 to 2 millimeters. The opening 52 preferably is positioned close to the disc 52. The blade 40 is 5 millimeters thick but may be modified depending on the quality and strength of the plastic comprising the applicator tip 20. The tip 46 in the illustrated embodiment is flat cut and rounded. In alternate embodiments (not illustrated) the blade 40 is ribbed. In another alternate embodiment, the tip 46 of the blade 40 is cut at an angle for coloring, highlighting, or writing. In a preferred embodiment, the length of the blade 40 is about 25 millimeters. The handle has a 5 millimeter diameter and a length of about 20 millimeters for being grippingly engaged by the bore 28. The disc 50 has a height of about 3 to 5 millimeters and extends outwardly 1 to 2 millimeters from the handle 42.

This specification has described the preferred embodiment of the present invention, its construction and its method of use. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A dispenser for applying a uniform film of water as a narrow band to a gummed surface of an envelope, comprising:

a container having an open neck and rigid sidewalls for holding a supply of water in free state;

an open-ended coupler removably attached at a threaded first end to the neck of the container, the coupler having a second open end;

an annular ring disposed concentrically on a longitudinal axis of the coupler at a lower portion thereof by arms extending radially from an inner surface of the coupler to the ring;

an applicator formed of a material that allows water to pass in a uniform way, comprising:

a wedge-shaped blade with a tip at a distal end;

a cylindrical handle configured for being grippingly received in a second open end of the coupler;

and an air bore extending along a line coaxial with the longitudinal axis from a first opening in a bottom of the handle to a second opening in a side of the blade for communicating air into the container; and an air tube received in the first opening and extending from the handle through the annular ring into the container, whereby the water, being transferred by gravity and diffused by capillary action through the handle to the tip of the applicator in the inverted container, passes through the tip and is applied to a gummed surface of an envelope in contact therewith as a narrow band of a uniform film of water and the tube communicates air through the second opening to the interior of the container to relieve the change in pressure in the container.

2. The dispenser as recited in claim 1 wherein the applicator is formed of a porous plastic having a plurality of pores of between about 20 and 500 microns.

3. The dispenser as recited in claim 1, wherein the applicator si formed of a felt with density sufficient to provide uniform flow.

4. The dispense as recited in claim 1, wherein:

the open second end includes an annular groove in the inner surface of the couple; and the applicator further comprises a flange-like disk extending outwardly from a mid-portion of the applicator between the blade and the handle for engaging the annular groove.

* * * * *